US009610621B2

(12) United States Patent
Verzola

(10) Patent No.: US 9,610,621 B2
(45) Date of Patent: Apr. 4, 2017

(54) APPARATUS FOR DEFORMING A METAL BAR HAVING A RECTANGULAR SECTION UP TO OBTAINING A METAL BAR HAVING A TRAPEZOIDAL OR HEXAGONAL SECTION, AND A SYSTEM AND A METHOD FOR REALISING A SPIRAL, STARTING FROM A METAL BAR HAVING A RECTANGULAR SECTION

(71) Applicant: MILLE S.R.l., Castelnovo Bariano (Rovigo) (IT)

(72) Inventor: Lorenzo Verzola, Castelnovo Bariano (IT)

(73) Assignee: MILLE S.R.L., Castelnov O Bariano (IT)

( * ) Notice: Subject to any disclaimer, the term of this patent is extended or adjusted under 35 U.S.C. 154(b) by 0 days.

(21) Appl. No.: 14/912,823

(22) PCT Filed: Nov. 2, 2012

(86) PCT No.: PCT/IB2012/056120

§ 371 (c)(1),
(2) Date: Feb. 18, 2016

(87) PCT Pub. No.: WO2013/104957

PCT Pub. Date: Jul. 18, 2013

(65) Prior Publication Data

US 2016/0193636 A1 Jul. 7, 2016

(30) Foreign Application Priority Data

Jan. 13, 2012 (IT) ..... BO2012A0014

(51) Int. Cl.
*B21B 1/16* (2006.01)
*B21D 11/06* (2006.01)

(52) U.S. Cl.
CPC ..... *B21B 1/16* (2013.01); *B21D 11/06* (2013.01)

(58) Field of Classification Search
CPC ..... B21D 11/06; B21B 1/16
See application file for complete search history.

(56) References Cited

U.S. PATENT DOCUMENTS 1,902,034 A * 3/1933 Knight ..... B21B 27/02 72/237
2,815,790 A 12/1957 Mayrath
5,678,440 A * 10/1997 Hamilton ..... B21D 11/06 72/136

FOREIGN PATENT DOCUMENTS

DE 562 621 C 10/1932
GB 736 838 A 9/1955

(Continued)

*Primary Examiner* — Teresa M Ekiert
(74) *Attorney, Agent, or Firm* — R. Neil Sudol; Henry D. Coleman

(57) ABSTRACT

An apparatus (1) for deforming a metal bar (2) having a rectangular section up to obtaining a metal bar (2) having a trapezoidal section or a hexagonal section, the metal bar (2) having a rectangular section comprising a first lateral wall (3) and a second lateral wall (4) which are opposite one another, and a third lateral wall (5), the apparatus comprising: a first rotatable roller (11) which has a first conical wall (12); a second rotatable roller (13) which has a second conical wall (14); the first roller (11) and the second roller (13) being arranged with respect to one another such that: the first conical wall (12) and the second conical wall (14) are facing one another; and when the metal bar (2) having a rectangular section crosses a spatial region comprised between the first conical wall (12) and the second conical wall (14) with the relative third lateral wall (5) facing externally, they can press respectively against the first lateral wall (3) and the second lateral wall (4), deforming the metal (Continued)

bar (2) until it takes on a trapezoidal or hexagonal shape; guide means for deformation (15) which are arranged with respect to the first roller (11) and the second roller (13) such as to abut the third lateral wall (5) of the metal bar (2) and for guiding the deformation of the metal bar (2) in such a way that the metal bar (2) maintains a straight development, the guide means for deformation (15) being mobile in a distancing-nearing direction with respect to the first roller (11) and the second roller (13).

7 Claims, 7 Drawing Sheets

(56) References Cited

FOREIGN PATENT DOCUMENTS

| | | | |
|---|---|---|---|
| JP | 61 099526 | A | 5/1986 |
| WO | WO 94/06579 | A1 | 3/1994 |

* cited by examiner

APPARATUS FOR DEFORMING A METAL BAR HAVING A RECTANGULAR SECTION UP TO OBTAINING A METAL BAR HAVING A TRAPEZOIDAL OR HEXAGONAL SECTION, AND A SYSTEM AND A METHOD FOR REALISING A SPIRAL, STARTING FROM A METAL BAR HAVING A RECTANGULAR SECTION

FIELD OF THE INVENTION

The present invention relates to the technical sector concerning deformation of metal bars for obtaining spirals.

In particular, the invention relates to an apparatus for deforming a metal bar having a rectangular section up to obtaining a metal bar having a trapezoidal section or a hexagonal section, as well as to a system and a method for realising a spiral starting from a metal bar having a rectangular section.

A metal bar (2) having a rectangular section (see FIGS. 1, 2) comprises: a first lateral wall (3) and a second lateral wall (4) which are opposite one another, and a third lateral wall (5) and a fourth lateral wall (6) which are opposite one another and define the thickness of the metal bar (2) and are both connected to the first lateral wall (3) and the second lateral wall (4).

PRIOR ART

An apparatus is known (not illustrated in the appended figures) which is able to deform a metal bar (2) having a rectangular section with the aim of obtaining a corresponding spiral (7) (see FIG. 3). A spiral (7) thus obtained can be thereafter fixed to a central shaft (8) such as to form a screw (9) for transporting products, see FIG. 4.

A known apparatus of this type comprises two trunco-conical and counter-rotating rotatable rollers; the two rollers are arranged facing one another and in close proximity to one another in order to press respectively against the first lateral wall (3) and the second lateral wall (4) of the metal bar (2) when the metal bar (2) crosses the region of space comprised between the above-cited conical walls; and it is orientated in such a way that the first lateral wall (3) faces a conical wall, the second lateral wall (4) faces the other conical wall, the third lateral wall (5) is facing towards the conical walls and the fourth lateral wall (6) is faced towards the outside.

The rotation of the rollers and the locking and compressing action which they exert causes a crushing of the metal bar (2) with a consequent formation of a spiral (7) having a trapezoidal transversal section (FIG. 4).

The trapezoidal transversal section thus-obtained comprises a larger base identified by the third lateral wall (5) (which is fixed to the central shaft 8), a smaller base identified by the fourth lateral wall (6), and two oblique sides identified respectively by the first lateral wall (3) and the second lateral wall (4).

The part of metal bar (2) which most greatly undergoes the crushing is the one in proximity and at the fourth lateral wall (6), which forms the external profile of the spiral (7). The third lateral wall (5) therefore undergoes a reduction in height.

Once the spiral (7) has been mounted on a central shaft (8) such as to form a screw (9), the part of the spiral (7) more greatly exposed to wear is the part at the relative external profile, as it is destined to contact the products to be transported.

Unfortunately the part of the spiral (7) which is at the relative external profile is also the one having the smallest thickness, for the reasons outlined above. Once the thickness which the external edge of the spiral (7) has been defined, it is therefore necessary to use original metal bars (2) having an increased thickness, which inevitably leads to an over-dimensioning of the spiral (7) at the relative internal profile destined to be fixed to the central shaft (8).

SUMMARY OF THE INVENTION

The aim of the present invention consists in obviating the above-mentioned drawback.

The above aim is obtained by means of an apparatus for deforming a metal bar having a rectangular section up to obtaining a metal bar having a trapezoidal or hexagonal section, according to claim 1. The guide means to deformation act during the deformation of the metal bar by means of the rollers with the aim of maintaining the original straight development of the metal bar; these means, therefore, prevent the bar from assuming, during the deformation step, a helical extension. The metal bar, however, is deformed up to assuming a trapezoidal or hexagonal transversal section; further, it has advantageously been found that the metal bar lengthens.

It is thereafter possible to use the metal bar thus obtained with the apparatus of known type that leads to obtaining the spirals, taking care to insert the metal bar such that the third lateral wall, and therefore the part of metal wall having a larger thickness, is facing towards the rollers. Thus a spiral is obtained the transversal section of which has a similar shape to the shape of a rectangular section; in other words a spiral is obtained having a practically constant thickness: consequently the screws comprising the spiral thus-obtained are lighter given a same requested thickness for the external edge.

Thus lighter spirals are obtained, as well as using a smaller quantity of metal material.

BRIEF DESCRIPTION OF THE DRAWINGS

Specific embodiments of the invention will be described in the following part of this document, according to what is set out in the claims and with the aid of the accompanying tables of drawings, in which:

DESCRIPTION OF THE PREFERRED EMBODIMENTS

Figure 3:
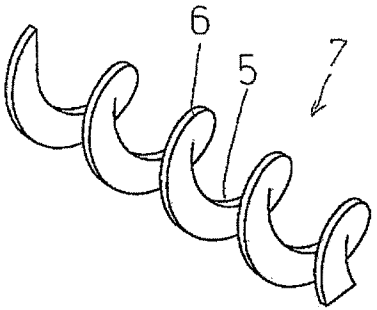
FIG. 3 is a perspective view of a spiral obtained by deformation of the metal bar of FIG. 1 by means of an apparatus of known type.
Figure 4:
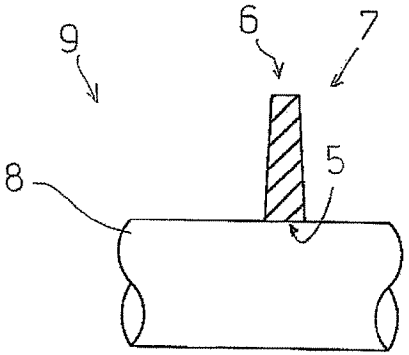
FIG. 4 is a partial view of a longitudinal section of a screw having a central shaft to which the spiral of FIG. 3 has been fixed.

With reference to the accompanying tables of drawings, general reference numeral (1) denotes the apparatus of the present invention.

Figure 2:
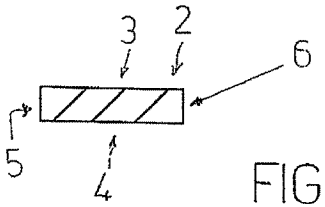
FIG. 2 is the view of section II-II of FIG. 1.
Figure 1:
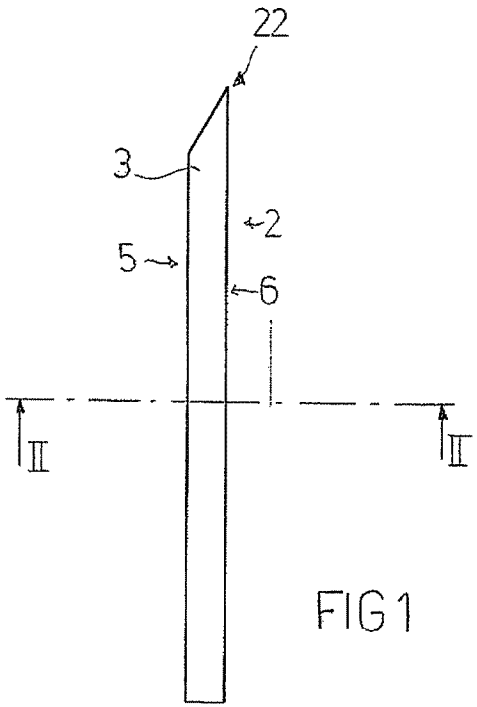
FIG. 1 is a view from above of a metal bar having a rectangular section and an end having a sawtooth profile.
Figure 7:
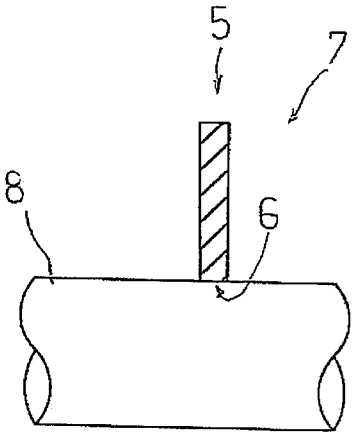
FIG. 7 is a partial view of a longitudinal section of a screw having a central shaft to which a spiral is fixed, obtained by the deformation of the metal bar of FIG. 5 by means of the mentioned apparatus of known type.

As already mentioned in the preamble to the present description, FIGS. 1 and 2 illustrate a metal bar (2) having a rectangular section, comprising: a first lateral wall (3) and a second lateral wall (4) which are opposite one another; and a third lateral wall (5) and a fourth lateral wall (6) which are opposite one another, defining the thickness of the metal bar (2) and are both connected to the first lateral wall (3) and the second lateral wall (4). In the example illustrated in the figures, the metal bar (2) has an end which conforms a sawtooth profile for reasons that will more fully emerge in the following; in particular, the point (22) is at the fourth lateral wall (6).

Figure 12:
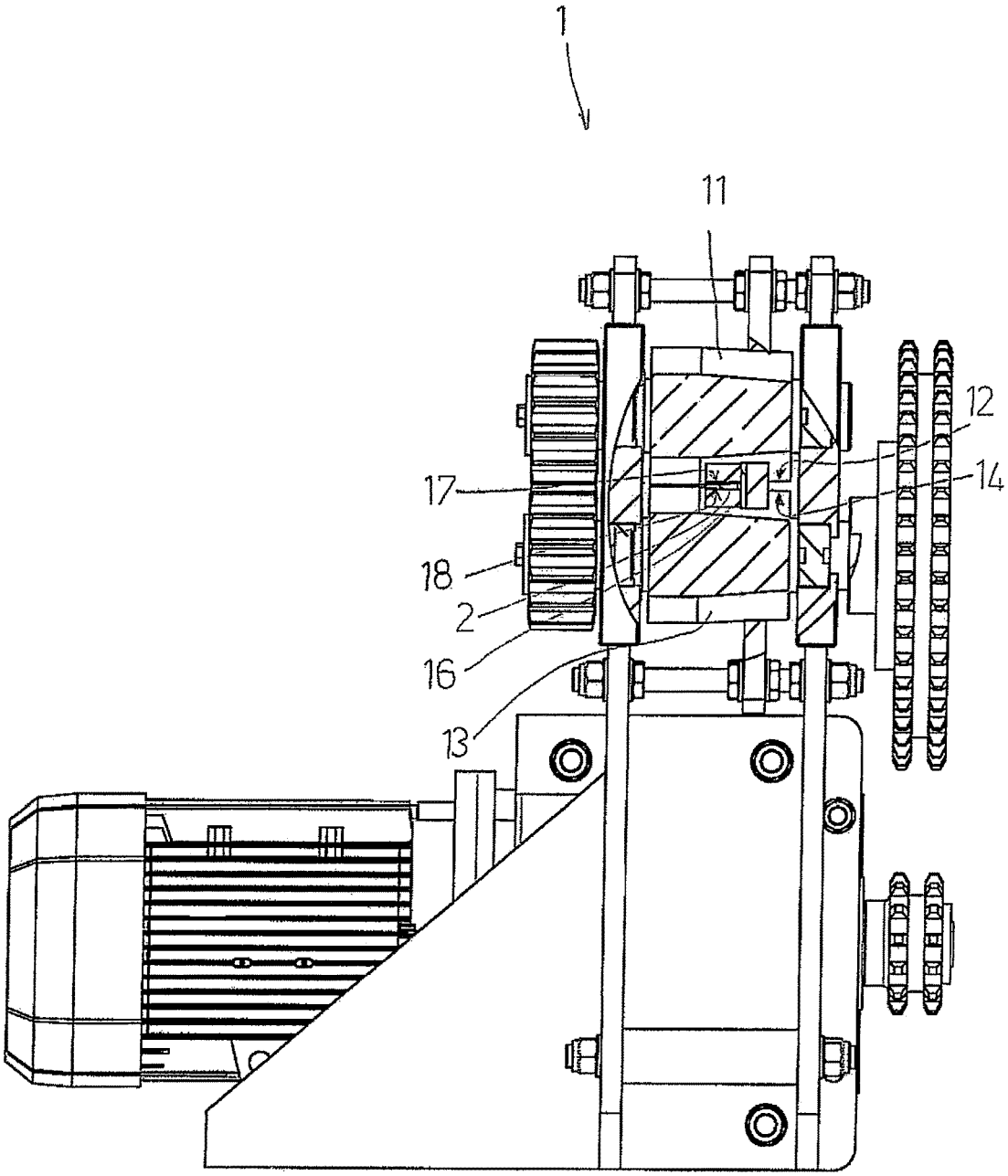
FIG. 12 is a rear view of the apparatus of the invention according to the direction indicated by arrow X3 of FIG. 8, in which some parts have been partially removed in order to better evidence others.

The apparatus (1) comprises: a first rotatable roller (11) which has a first conical wall (12) and is activatable in rotation; a second rotatable roller (13) which has a second conical wall (14) and is activatable in rotation; the first roller (11) and the second roller (13) being arranged facing one another such; that the first conical wall (12) and the second conical wall (14) are facing one another; and that when the metal bar (2) having a rectangular section crosses a spatial region comprised between the first conical wall (12) and the second conical wall (14) with the relative third lateral wall (5) facing externally, they can press respectively against the first lateral wall (3) and the second lateral wall (4) (see for example FIG. 12), deforming the metal bar (2) so that it takes on a trapezoidal shape; guide means for deformation (15) which are arranged with respect to the first roller (11) and the second roller (13) such as to abut the third lateral wall (5) of the metal bar (2) and for guiding the deformation of the metal bar (2) in such a way that the metal bar (2) maintains a straight development.

The guide means for deformation (15) act during the deformation of the metal bar (2) by application of the first roller (11) and the second roller (13) with the aim of maintaining the original straight extension of the metal bar (2); the guide means for deformation (15) prevent the metal bar (2) from assuming, during deformation, a helical extension. The metal bar (2), however, is deformed up to assuming a trapezoidal transversal section; further, it has advantageously been found that the metal bar (2) stretches.

In a case in which only a portion of the first lateral wall (3) and the second lateral wall (4) are crushed, the deformed metal bar (2) can take on a hexagonal section (this example is not illustrated in the figures).

The first roller (11) and the second roller (13) can be vertically superposed, with the first roller (11) arranged superiorly to the second roller (13).

The first roller (11) and the second roller (13) are for example truncoconical; they are activatable in rotation in order to be counter-rotating.

The first roller (11) and the second roller (13) are arranged such that the first conical wall (12) and the second conical wall (14) define a sort of wedge; in other words, the first conical wall (12) and the second conical wall (14) diverge from one another.

The first roller (11) and the second roller (13) are preferably arranged symmetrically with respect to a horizontal plane; this means that the axes of the first roller (11) and the second roller (13) are horizontal and parallel to one another or orientated by a same angle with respect to a horizontal reference plane.

Figure 6:
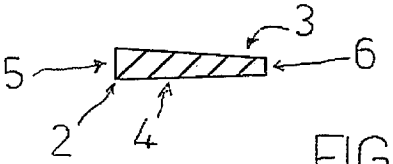
FIG. 6 is the view of section VI-VI of FIG. 5.
Figure 5:
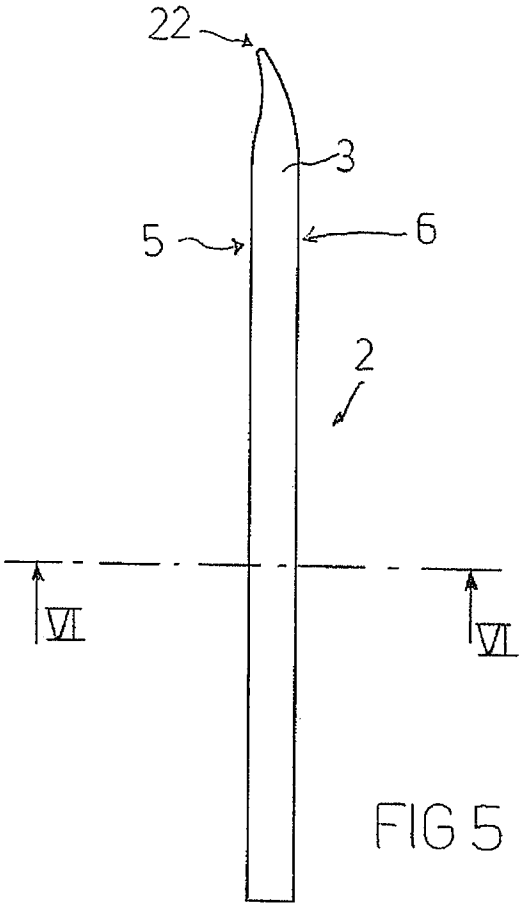
FIG. 5 is a view from above of a metal bar having a trapezoidal section obtained by the deformation of the metal bar of FIG. 1 by means of the apparatus of the invention.

The first conical wall (12) and the second conical wall (14) advantageously exert same stresses on the metal bar (2), which leads to a uniform lengthening of the metal bar (2); the metal bar (2) thus-deformed exhibits a plane of symmetry which divides the bar into a first longitudinal portion comprising the relative first lateral wall (3) and a second longitudinal portion comprising the relative second lateral wall (4), see FIG. 6. The section of the metal bar (2) thus-deformed has the shape of an isosceles trapeze.

The relative position of the first roller (11) with respect to the second roller can be regulated according to the dimensions of the metal bar (2) to be deformed.

The rotation of the first roller (11) and the second roller (13) and the locking and compressing action they exert cause a crushing of the metal bar (2).

The trapezoidal transversal section thus obtained comprises a larger base identified by the third lateral wall (5), a smaller base identified by the fourth lateral wall (6), and two oblique sides respectively identified by the first lateral wall (3) and the second lateral wall (4). The part of metal bar (2) that is most greatly subjected to the crushing is the one in proximity and at the fourth lateral wall (6), which thus experiences a reduction in height.

The guide means for deformation (15) can comprise a first lateral abutment wall (16), preferably straight, which is arranged downstream of the spatial region comprised between the first conical wall (12) and the second conical wall (14) with respect to the advancement direction (A) of the metal bar (2) such as to guide the deformation of the metal bar (2) in such a way that the metal bar (2) maintains a straight development.

The guide means for deformation (15) can preferably further comprise a first upper abutment wall (17) and a first lower abutment wall (18) which are adjacent to the first lateral abutment wall (16) such as to guide the deformation of the metal bar (2) in such a way that the metal bar (2) maintains a straight development. The first upper abutment wall (17) and the first lower wall: are arranged downstream of the spatial region comprised between the first conical wall (12) and the second conical wall (14) with respect to the advancement direction (A) of the metal bar (2); they are preferably straight; and they are connected to the first lateral abutment wall (16) such as to form an overall shape having a C-section in order better to guide the deformation of the metal bar (2) in outlet from the spatial region comprised between the first conical wall (12) and the second conical wall (14).

In addition, the guide means for deformation (15) further comprise a second lateral abutment wall (19), preferably straight, which is arranged upstream of the spatial region comprised between the first conical wall (12) and the second conical wall (14) with respect to the advancement direction (A) of the metal bar (2) such as to guide the deformation of the metal bar (2) in such a way that the metal bar (2) maintains a straight development. The second lateral abutment wall (19) thus functions as an aid for better guiding of the deformation of the metal bar (2).

The guide means for deformation (15) can preferably comprise a second upper abutment wall (20) and a second lower abutment wall (21) which are adjacent to the second lateral abutment wall (19) such as to guide the deformation of the metal bar (2) in such a way that the metal bar (2) maintains a straight development. The second upper abutment wall (20) and the second lower wall: are arranged upstream of the spatial region comprised between the first conical wall (12) and the second conical wall (14) with respect to the advancement direction (A) of the metal bar (2); are preferably straight; and are connected to the second lateral abutment wall (19) such as to form an overall C-shape in order better to guide the deformation of the metal bar (2) in inlet to the spatial region comprised between the first conical wall (12) and the second conical wall (14).

As the metal bar (2) has a rectangular section (FIGS. 1, 2) it has to be inserted between the first roller (11) and the second roller (13) in an advancement direction which is substantially perpendicular to the axes of the first roller (11) and the second roller (13). In particular, the first end to enter is preferably the one having the sawtooth profile; the fourth lateral wall (6) is appropriately faced towards the first conical wall (12) and the second conical wall (14) such that the point (22) of the end of the metal bar (2) is distal with respect to the first lateral abutment wall (16).

Figure 8:
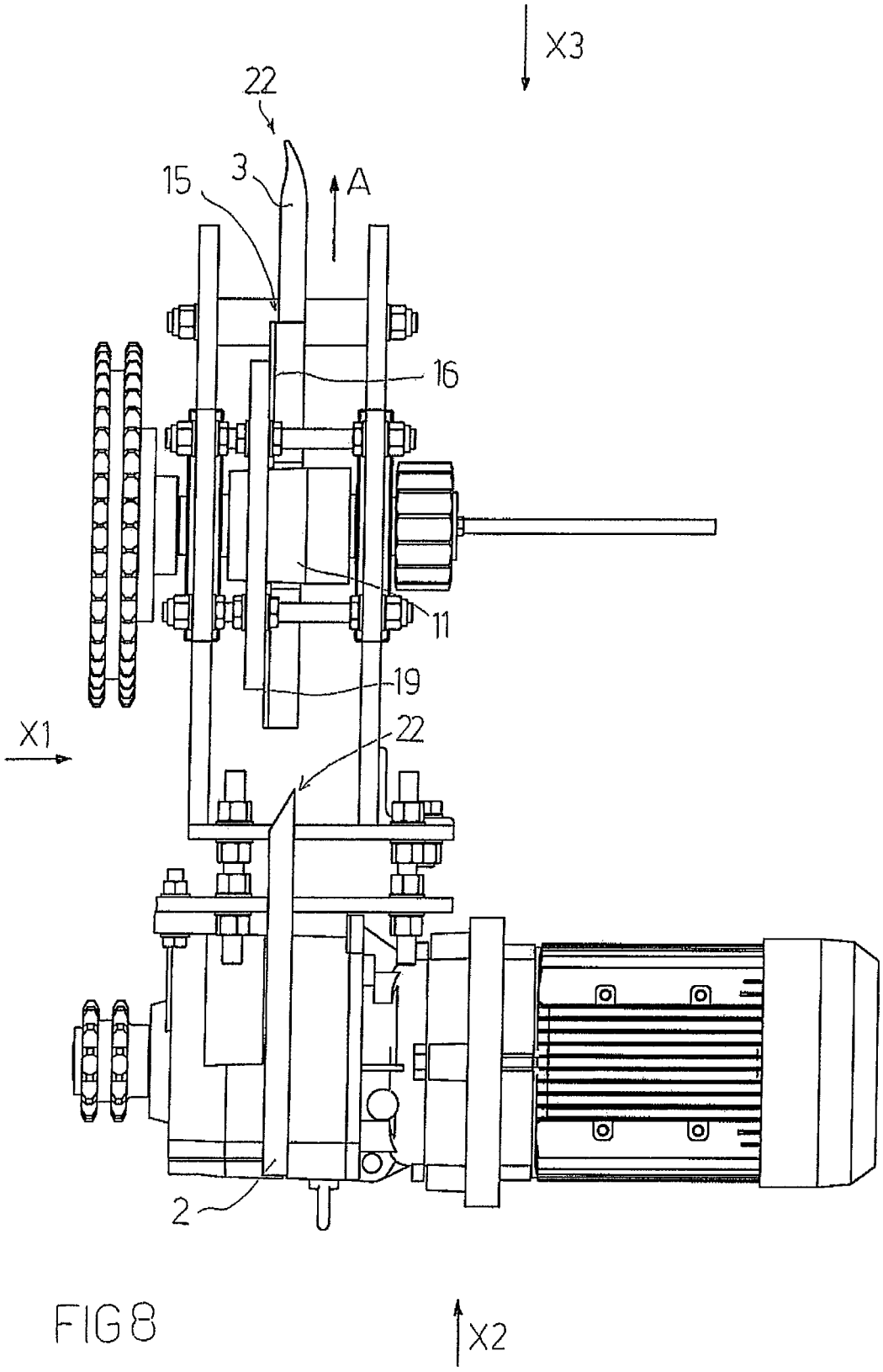
FIG. 8 is a view from above of the apparatus of the invention.
Figure 9:
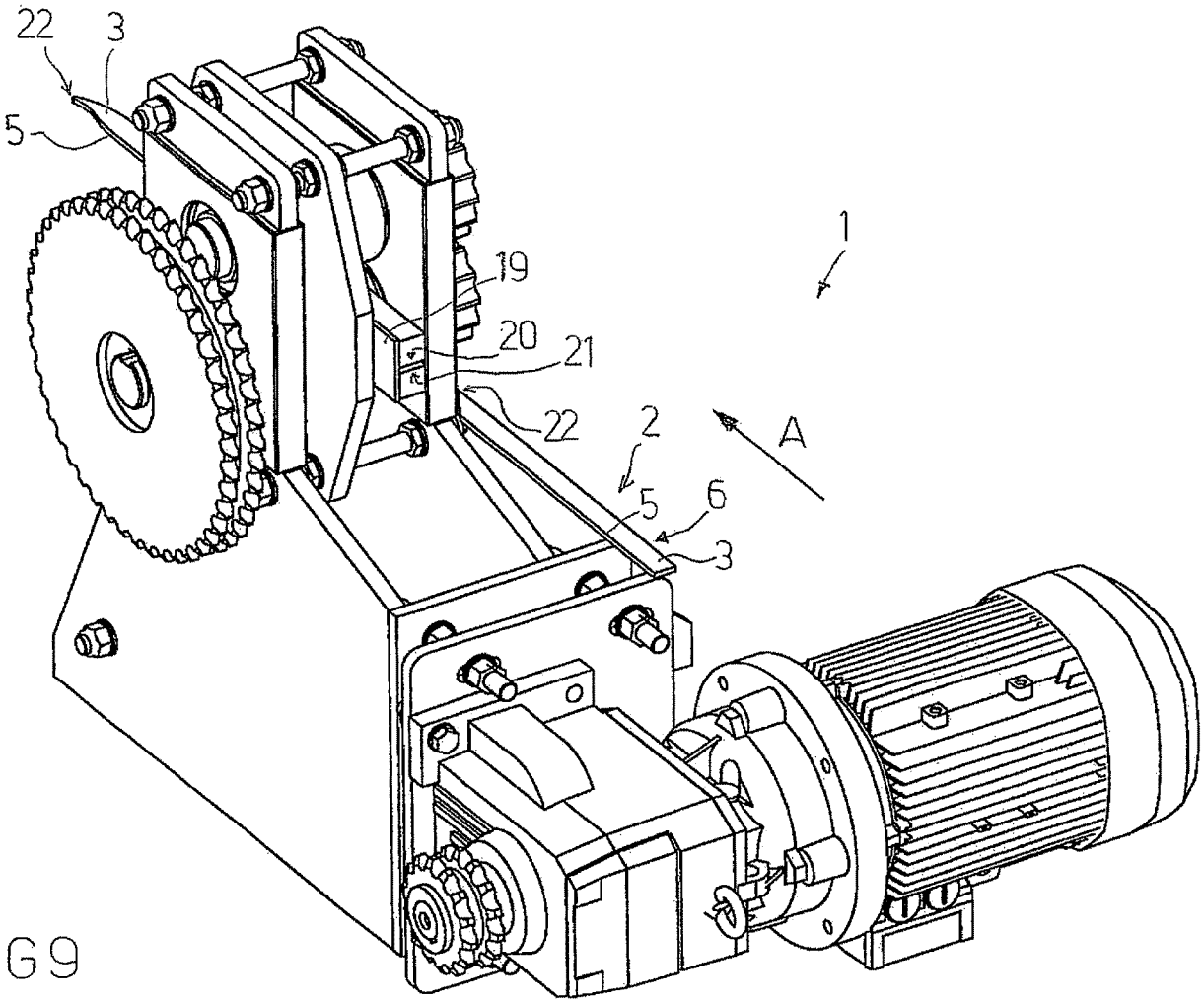
FIG. 9 is a perspective view of the apparatus of FIG. 8.
Figure 10:
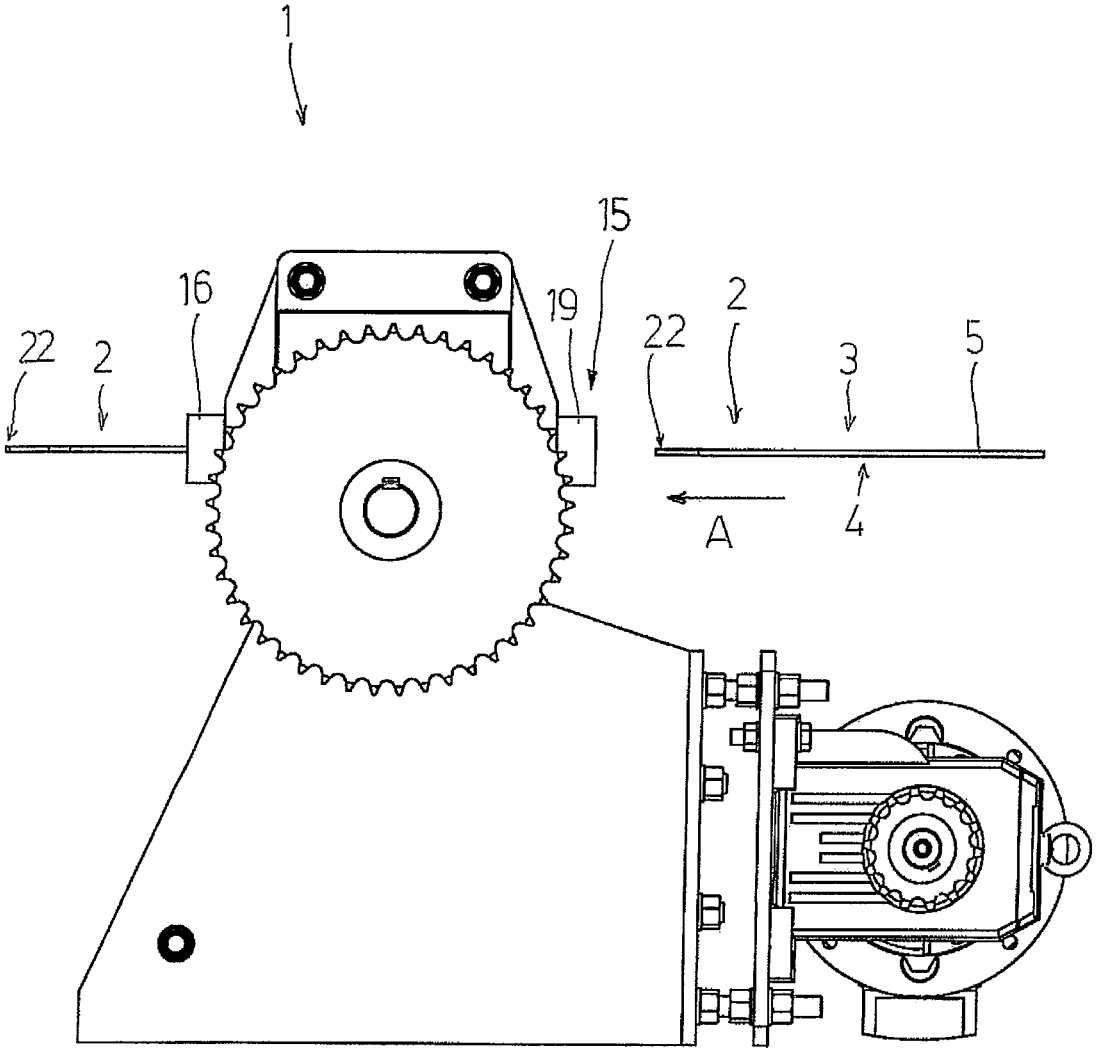
FIG. 10 is a lateral view of the apparatus of the invention according the direction indicated by arrow X1 of FIG. 8.
Figure 11:
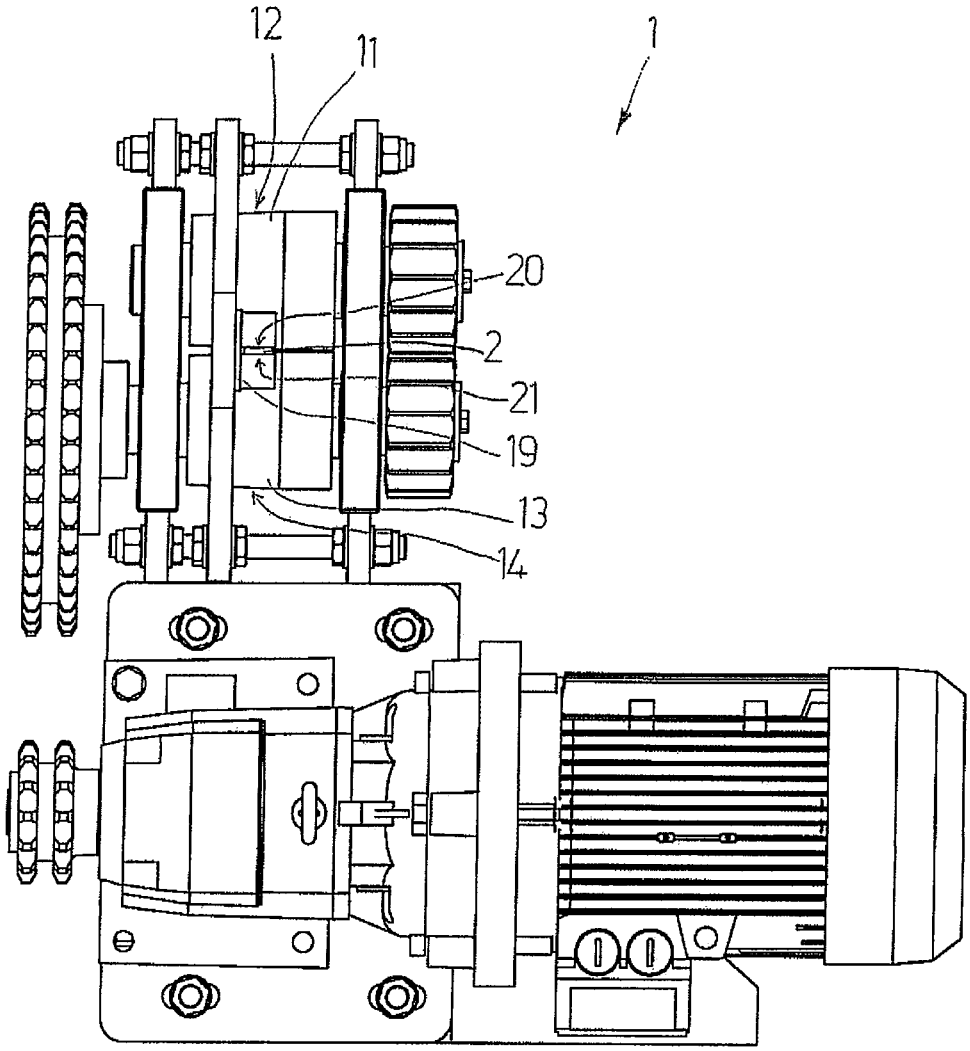
FIG. 11 is a frontal view of the apparatus of the invention according to the direction indicated by arrow X2 in FIG. 8.

FIG. 8 shows how the point (22) is deformed and how the metal bar (2) is advantageously lengthened. The pointed end of the metal bar (2) is deformed and curved; if it were not for the presence of the first lateral abutment wall (16), the metal bar (2), exiting from the first spatial region comprised between the first conical wall (12) and the second conical wall (14), and therefore in outlet from the apparatus (1), would tend to form a helix; instead, the presence of the first lateral abutment wall (16) encounters the point (22) and forces the metal bar (2) exiting from the apparatus (1) to follow a straight trajectory according to the orientation of the first lateral abutment wall (16). In this sense, therefore, the first lateral abutment wall (16) guides the deforming of the metal bar (2) in order to keep the metal bar (2) straight.

The first lateral abutment wall (16) (though this is equally true of the above-mentioned remaining walls 17, 18, 19, 20, 21 of the guide means for deformation 15) develops perpendicularly with respect to the first roller (11) and the second roller (13) and is fixed to the frame of the apparatus (1).

It is therefore preferable to introduce a metal bar (2) having a pointed end, for example in the shape of a sawtooth, into the inlet of the apparatus (1).

Alternatively, a metal bar (2) can be used that has flat ends, i.e. having end walls that are perpendicular to the axis of the metal bar (2) as long as an initial step is performed involving pre-introduction of the metal bar (2) into the apparatus (1); in other words, with the first roller (11) and the second roller (13) stationary, the metal bar (2) has to be inserted between the first conical wall (12) and the second conical wall (14). To do this the guide means for deformation (15) are preferably mobilised distancingly-nearingly to the first roller (11) and the second roller (13); in other words, with reference to the illustrated example, the first lateral abutment wall (16) can be made mobile, as can the first upper abutment wall (17), first lower abutment wall (18), the second lateral abutment wall (19), the second upper abutment wall (20), the second lower abutment wall (21), in distancing-nearing direction with respect to the first roller (11) and the second roller (13).

Thus, in general terms, before activating the first roller (11) and the second roller (13) in rotation and moving the metal bar (2) in advancement according to the advancement direction (A), it is necessary to transversally insert the metal bar (2) having a rectangular section into the spatial region comprised between the first conical wall (12) and the second conical wall (14), such that a relative end of the metal bar (2) is downstream of the spatial region comprised between the first conical wall (12) and the second conical wall (14) with respect to the advancement direction (A) in which the metal bar (2) can be subsequently advanced.

From the foregoing it can be deduced that it is preferable to use pointed metal bars, but this is not necessary if the above-described step of pre-introduction of the metal bar (2) is carried out.

The present invention also relates to a system for realising a spiral (7) starting from a metal bar (2) having a rectangular section, which comprises: the apparatus (1) of the invention, as described above, and the known-type apparatus described in the preamble and not illustrated in the accompanying figures of the drawings.

The metal bar (2) having the rectangular section first has to be introduced into the apparatus (1) of the invention and then used with the apparatus of known type: in other words, in a production process for obtaining spirals, the apparatus of known type is arranged downstream of the apparatus (1) of the invention.

The apparatus of known type described in the preamble comprises: a third rotatable roller which has a third conical wall and is activatable in rotation; a fourth rotatable roller which has a fourth conical wall and is activatable in rotation; the third roller and the fourth roller being arranged with respect to one another such that: the third conical wall and the fourth conical wall are opposite one another; and when the metal bar (2) having a trapezoidal section or a hexagonal section crosses the spatial region comprised between the third conical wall and the fourth conical wall with the relative third lateral wall (5) facing towards the third conical wall and the fourth conical wall, they can press respectively against the first lateral wall (3) and the second lateral wall (4), deforming the metal bar (2) such that it assumes a spiral progression (7).

The third roller and the fourth roller are preferably arranged symmetrically with respect to a horizontal plane as well as dimensioned according to the first roller (11) and second roller (12) such that the third lateral wall (5), destined to form the external edge of the spiral (8), has a thickness that is equal to or greater than the thickness of the fourth lateral wall (6), destined to form the internal edge of the spiral (8).

With reference to the above-described system, a method is defined to realise a spiral (7) starting from a metal bar (2) having a rectangular section, also object of the present invention, comprising the steps of:

supplying a metal bar (2) having a rectangular section comprising a first lateral wall (3) and a second lateral wall (4) which are opposite one another, and a third lateral wall (5) which is connected to the first lateral wall (3) and to the second lateral wall (4) and which defines a thickness of the metal bar (2);

advancing the metal bar (2) into the spatial region comprised between the first conical wall (12) and the second conical wall (14) with the relative third lateral wall (5) facing externally, such that the first roller (11) and the second roller (13) press respectively against the first lateral wall (3) and the second lateral wall (4), deforming the metal bar (2) until the metal bar (2) takes on a trapezoidal or hexagonal section and such that the guide means for deformation (15) abut the third lateral wall (5) of the metal bar (2)

and guide the deformation of the metal bar (2) such that the metal bar (2) maintains a straight development;

advancing the metal bar (2) into the spatial region comprised between the third conical wall and the fourth conical wall with the relative third lateral wall (5) facing towards the third conical wall and the fourth conical wall, such that the third roller and the fourth roller press against the first lateral wall (3) and the second lateral wall (4), deforming the metal bar (2) until the metal bar (2) takes on a spiral development (7).

A further advantage of having the guide means for deformation (15) mobile consists in the fact that the apparatus (1) of the present invention as described above can be used, using also metal bars having rectangular sections and without a pointed end, in order to obtain a metal bar (2) having a trapezoidal section, and thereafter distancing the guide means for deformation (15) with respect to the first roller (11) and the second roller (13) and using the apparatus (1) of the invention like the apparatus of known type, as described above in order to obtain spirals. In other words, this functioning method of the apparatus (1) of the invention would enable obtaining a spiral (7) starting from a metal bar (2) having a rectangular section even using only the apparatus (1) of the invention.

By way of example a metal bar (2) has been used having a rectangular section having a length of 6000 m, width 25 mm and thickness 6 mm; this metal bar (2) has been used in the known-type apparatus and has produced a spiral (7) having a trapezoidal transversal section in which the larger base, destined to be fixed to the central shaft (8), is 7.8 mm, the smaller base, destined to form the external edge of the spiral (7), is 5.3 mm, and the height is 25 mm.

Therefore, using the same metal bar (2) having the above specifications in the apparatus (1) of the invention, a metal bar (2) is obtained having a trapezoidal section in which the larger base is 5.8 mm, the smaller base is 3.1 mm, the width is 27 mm and the length is 7500 mm. This means that the deformed metal bar (2) has been widened (from 25 mm to 27 mm) and considerably lengthened (from 6000 mm to 7500 mm, i.e. by 25%). Subsequently, the use of the metal bar (2) with a trapezoidal section with the known-type apparatus as described above has produced a spiral (7) having a trapezoidal section in which the larger base, destined to be fixed to the central shaft (8) is 5.0 mm, the smaller base, destined to form the external edge of the spiral (7) is 4.5 mm and the width is 27 mm.

Given a same thickness to be obtained for the external edge of the spiral (7) a considerable saving can be obtained in metal material used with respect to the prior art; in the example described, if the widening of the metal bar (2) is ignored (from 25 mm to 27 mm), which by itself is advantageous, a saving of material of 25% is obtained.

The above is intended to be by way of non-limiting example, and any eventual constructional variants are considered to fall within the protective scope of the present technical solution, as claimed in the following.

The invention claimed is:

1. An apparatus for deforming a metal bar having a rectangular section up to obtaining a metal bar having a trapezoidal section or a hexagonal section, the metal bar having a rectangular section comprising a first lateral wall and a second lateral wall which are opposite one another, and a third lateral wall which is connected to the first lateral wall and to the second lateral wall and which defines a thickness of the metal bar, the apparatus comprising:

a first rotatable roller which has a first conical wall and is activatable in rotation;

a second rotatable roller which has a second conical wall and is activatable in rotation;

the first roller and the second roller being arranged with respect to one another such that: the first conical wall and the second conical wall are facing one another; and when the metal bar having a rectangular section crosses a spatial region comprised between the first conical wall and the second conical wall with the relative third lateral wall facing externally, the first roller and the second roller can press respectively against the first lateral wall and the second lateral wall, deforming the metal bar until the metal bar takes on a trapezoidal or hexagonal shape;

guide means for deformation which are arranged with respect to the first roller and the second roller such as to abut the third lateral wall of the metal bar and for guiding the deformation of the metal bar in such a way that the metal bar maintains a straight development, wherein the second conical wall of the second roller is conical, and in that the guide means for deformation are mobile in a distancing-nearing direction with respect to the first roller and the second roller, wherein the guide means for deformation comprise:

a first lateral abutment wall (16) which is arranged downstream of the spatial region comprised between the first conical wall (12) and the second conical wall (14) with respect to the advancement direction (A) of the metal bar (2); and a first upper abutment wall and a first lower abutment wall which are adjacent to the first lateral abutment wall and arranged downstream of the spatial region between the first conical wall and the second conical wall with respect to the advancement direction of the metal bar, the first upper abutment wall and the first lower abutment wall being connected to the first lateral abutment wall so as to form an overall shape having a C-section in order better to guide the deformation of the metal bar at an outlet from the spatial region between the first conical wall and the second conical wall.

2. The apparatus of claim 1, wherein the first roller is arranged above the second roller.

3. The apparatus of claim 1, wherein the guide means for deformation further comprise a second lateral abutment wall which is arranged upstream of the spatial region comprised between the first conical wall and the second conical wall with respect to the advancement direction of the metal bar such as to guide the deformation of the metal bar in such a way that the metal bar maintains a straight development.

4. The apparatus of claim 3, wherein the guiding means for deformation further comprise a second upper abutment wall and a second lower abutment wall which are adjacent to the second lateral abutment wall such as to guide the deformation of the metal bar in such a way that the metal bar maintains a straight development.

5. A system for realizing a spiral starting from a metal bar having a rectangular section, comprising: the apparatus of claim 1; a third rotatable roller which has a third conical wall and is activatable in rotation; a fourth rotatable roller which has a fourth conical wall and is activatable in rotation; the third roller and the fourth roller being arranged with respect to one another such that: the third conical wall and the fourth conical wall are opposite one another; and when the metal bar having a trapezoidal section or a hexagonal section crosses the spatial region comprised between the third conical wall and the fourth conical wall with the relative third lateral wall facing towards the third conical wall and the fourth conical wall, the third roller and the fourth roller can press respectively against the first lateral wall and the second lateral wall, deforming the metal bar such that the metal bar assumes a spiral progression.

6. A method for manufacturing a spiral starting from a metal bar having a rectangular section, the method being usable with the system of claim 5, the method comprising steps of: supplying a metal bar having a rectangular section comprising a first lateral wall and a second lateral wall which are opposite one another, and a third lateral wall which is connected to the first lateral wall and to the second lateral wall and which defines a thickness of the metal bar; distancing the guide means for deformation from the first roller and from the second roller; with the first roller and the second roller inactive, transversally inserting the metal bar having a rectangular section into the spatial region comprised between the first conical wall and the second conical wall, such that a relative end of the metal bar is downstream of the spatial region comprised between the first conical wall and the second conical wall and in such a way that the relative third lateral wall is facing externally; nearing the guide means for deformation to the first roller and to the second roller; activating the first roller and the second roller such that the first roller and the second roller press respectively against the first lateral wall and the second lateral wall, deforming the metal bar such that the metal bar takes on a trapezoidal or hexagonal section and in such a way that the guide means for deformation encounter the third lateral wall of the metal bar and guide the deformation of the metal bar in such a way that the metal bar maintains a straight development; advancing the metal bar into the spatial region comprised between the third conical wall and the fourth conical wall with the relative third lateral wall facing towards the third conical wall and the fourth conical wall, such that the third roller and the fourth roller press against the first lateral wall and the second lateral wall, deforming the metal bar so that the metal bar takes on a spiral development.

7. A method for manufacturing a spiral starting from a metal bar having a rectangular section, the method being usable with a system comprising: an apparatus for deforming a metal bar having a rectangular section up to obtaining a metal bar having a trapezoidal section or a hexagonal section, the metal bar having a rectangular section comprising a first lateral wall and a second lateral wall which are opposite one another, and a third lateral wall which is connected to the first lateral wall and to the second lateral wall and which defines a thickness of the metal bar, comprising: a first rotatable roller which has a first conical wall and is activatable in rotation; a second rotatable roller which has a second conical wall and is activatable in rotation; the first roller and the second roller being arranged with respect to one another such that: the first conical wall and the second conical wall are facing one another; and when the metal bar having a rectangular section crosses a spatial region comprised between the first conical wall and the second conical wall with the relative third lateral wall facing externally, they can press respectively against the first lateral wall and the second lateral wall, deforming the metal bar so that the metal bar takes on a trapezoidal or hexagonal shape; guide means for deformation which are arranged with respect to the first roller and the second roller such as to abut the third lateral wall of the metal bar and for guiding the deformation of the metal bar in such a way that the metal bar maintains a straight development; the guide means comprising: a first lateral abutment wall which is arranged downstream of the spatial region comprised between the first conical wall and the second conical wall with respect to the advancement direction of the metal bar; a first upper abutment wall and a first lower abutment wall which are adjacent to the first lateral abutment wall and arranged downstream of the spatial region between the first conical wall and the second conical wall with respect to the advancement direction of the metal bar, the first upper abutment wall and the first lower abutment wall being connected to the first lateral abutment wall so as to form an overall shape having a C-section in order better to guide the deformation of the metal bar at an outlet from the spatial region between the first conical wall and the second conical wall;

a third rotatable roller which has a third conical wall and is activatable in rotation;

a fourth rotatable roller which has a fourth conical wall and is activatable in rotation; the third roller and the fourth roller being arranged with respect to one another such that: the third conical wall and the fourth conical wall are opposite one another; and when the metal bar having a trapezoidal section or a hexagonal section crosses the spatial region comprised between the third conical wall and the fourth conical wall with the relative third lateral wall facing towards the third conical wall and the fourth conical wall, the third conical wall and the fourth conical wall can press respectively against the first lateral wall and the second lateral wall, deforming the metal bar such that it assumes a spiral progression; the method comprising steps of:

providing a metal bar having a pointed end and having a rectangular section comprising a first lateral wall and a second lateral wall which are opposite one another, and a third lateral wall which is connected to the first lateral wall and the second lateral wall and which defines the thickness of the metal bar;

advancing the metal bar into the spatial region comprised between the first conical wall and the second conical wall such that: the first end to enter is the pointed end; the relative third lateral wall is facing externally; the first roller and the second roller press respectively against the first lateral wall and the second lateral wall, deforming the metal bar so that the metal bar takes on a trapezoidal or hexagonal section; the guide means for deformation encounter the third lateral wall of the metal bar and guide the deformation of the metal bar such that the metal bar maintains a straight development;

advancing the metal bar into the spatial region comprised between the third conical wall and the fourth conical wall with the relative third lateral wall facing towards the third conical wall and the fourth conical wall, such that the third roller and the fourth roller press against the first lateral wall and the second lateral wall, deforming the metal bar so that the metal bar takes on a spiral development.

* * * * *